US008245636B2

(12) United States Patent
Melotti

(10) Patent No.: US 8,245,636 B2
(45) Date of Patent: Aug. 21, 2012

(54) INTERCHANGEABLE DOCTOR BLADE ASSEMBLY

(75) Inventor: Renzo Melotti, S. Giorgio Monferrato (IT)

(73) Assignee: Bobst Group Italia S.p.A. (IT)

( * ) Notice: Subject to any disclaimer, the term of this patent is extended or adjusted under 35 U.S.C. 154(b) by 0 days.

(21) Appl. No.: 13/367,176

(22) Filed: Feb. 6, 2012

(65) Prior Publication Data

US 2012/0132095 A1 May 31, 2012

Related U.S. Application Data

(63) Continuation of application No. 12/252,464, filed on Oct. 16, 2008, now abandoned.

(30) Foreign Application Priority Data

Oct. 18, 2007 (EP) ..... 07020393

(51) Int. Cl.
*B41F 31/04* (2006.01)

(52) U.S. Cl. ..... 101/350.6; 101/157; 101/169; 101/350.1; 101/352.09; 118/261

(58) Field of Classification Search ..... 101/350.6
See application file for complete search history.

(56) References Cited

U.S. PATENT DOCUMENTS

| | | | |
|---|---|---|---|
| 4,789,432 | A | 12/1988 | Goodnow |
| 4,938,133 | A | 7/1990 | Bock |
| 4,964,336 | A | 10/1990 | Bock |
| 5,031,529 | A | 7/1991 | Greenwood |
| 5,140,901 | A | 8/1992 | John |
| 5,297,490 | A | 3/1994 | Schneider |
| 5,406,887 | A | 4/1995 | Hertel |
| 5,980,692 | A | 11/1999 | Goodnow |
| 6,029,573 | A | 2/2000 | Capdeboscq |

*Primary Examiner* — Jill Culler
(74) *Attorney, Agent, or Firm* — Ostrolenk Faber LLP

(57) ABSTRACT

Doctor blade assembly for rotogravure printing units, having a support structure for a doctor blade, a holding device of the support structure and a moving device for moving the holding device. The holding device includes a mounting suitable to fix either a chambered doctor blade or a non-chambered doctor blade to the moving device.

1 Claim, 6 Drawing Sheets

INTERCHANGEABLE DOCTOR BLADE ASSEMBLY

CROSS REFERENCE TO RELATED APPLICATION

The present application is a continuation under 37 C.F.R. §1.53(b) of prior U.S. application Ser. No. 12/252,464, filed Oct. 16, 2008, now abandoned, by Renzo Melotti entitled DOCTOR BLADE ASSEMBLY, which claims the priority of European Patent Application No. 07020393.0 filed Oct. 18, 2007 incorporated by reference herein.

TECHNICAL FIELD

The present invention relates to a doctor blade assembly for use with rotating print cylinders, in particular print cylinders of gravure or rotogravure printing presses.

BACKGROUND ART

Doctor blades are known in the field of printing apparatuses, in particular rotogravure printing presses in which a gravure printing roller applies ink or the like onto a film or web material to be printed, such as a packaging material.

In a rotogravure printing press, the doctor blade is arranged adjacent and substantially parallel to the rotation axis of the printing roller, which is typically engraved according to the graphics or patterns to be printed onto the material. A pan containing the ink or other substances to be applied to the material is usually provided beneath the printing roller, in such a position that the printing roller can be wet by the ink or the substance in the pan during its rotation.

The material to be printed is generally fed to the printing roller by a pressing roller, which is in close proximity of the printing roller so that the material can contact a generating line of the printing roller downstream of the ink pan and can be printed according to the patterns engraved on the printing roller.

The doctor blade is placed downstream of the ink pan and upstream of the pressing roller, with respect to the rotation direction of the printing roller, and is aimed at wiping off the excess ink from the engraved surface of the printing roller before it contacts the material to be printed, so that the ink remains only in the patterned recesses engraved on the surface of the printing roller.

During the above printing process, a common problem is usually encountered, which is that unused ink can accumulate beneath the doctor blade and some ink can splash on the material to be printed and on the inner walls of the chamber enclosing the printing roller. As a consequence, without a periodic cleaning of the printing group, quality of print cycles degrades in time. Therefore, cleaning of the doctor blade unit, which is in close proximity of the printing color ink is an extremely important requirement to maintain excellent print quality.

Another known problem is that not any kind of ink can be used with rotogravure printing presses. For instance, some inks may be too fast drying or have too low viscosity, which makes them unsuitable to gravure printing presses because of the large extension of the rotation arc between the ink pan beneath the printing roller and the pressing roller, the latter being above the printing roller.

On the other hand, within a same printing plant, a print cycle may need inks for high quality applications and another print cycle may need inks for lower quality applications or adapted for different materials to be printed. This would require two independent print presses, e.g. a rotogravure printing press using a non-chambered doctor blade and a flexographic printing press using a chambered doctor blade, and a lot of space would be accordingly needed. Moreover, providing two different printing presses at the same plant would be very expensive and would double operation and maintenance activities.

DISCLOSURE OF INVENTION

The aim of the instant invention is to solve the above problems, by providing an assembly which allows different inks or other substances for film or web materials to be used within the same printing press.

Within the above aim, an object of the invention is to allow the printing press to be easily switched from one printing mode to another printing mode.

Another object is to allow the assembly to be installed and used in existing rotary printing presses, in particular gravure or rotogravure printing presses, without substantially changing their mechanical structure and their operating software.

Yet another object of the invention is to reduce cleaning operations of rotary printing presses.

Not the least object is to provide an assembly which is further competitive from a merely economical standpoint.

This aim, these objects and other objects which will become apparent hereinafter are achieved by a doctor blade assembly for printing units, in particular for rotogravure printing units, comprising a support structure for a doctor blade, a holding device of the support structure and a moving means of the holding device, characterized in that the holding device comprises mounting means which are suitable to indifferently fix either a chambered doctor blade or a non-chambered doctor blade to the moving means.

Advantageously, the support structure is substantially L-shaped, with at least one arm of the L-shaped support structure being detachably fixed to the holding device by means of the mounting means. The mounting means may comprise any one of: at least one screw, a clamp, a snap-fit coupling, and a geometrical coupling.

Preferably, the support structure comprises at least one handle or a pair of handles.

The above aim and objects are also achieved by a rotogravure printing unit comprising at least one gravure printing roller and at least one pressing roller adjacent to said gravure printing roller, characterized in that the rotogravure printing unit comprises the above doctor blade assembly.

In such rotogravure printing unit, a chambered doctor blade can be removably fixed to the moving means by virtue of the mounting means, the moving means being suitable to adjust the position of the chambered doctor blade with respect to the lateral surface of said gravure printing roller.

Further characteristics and advantages of the present invention will become apparent from the following description of particular embodiments thereof, illustrated only by way of non-limitative examples in the accompanying drawings.

BRIEF DESCRIPTION OF FIGURES IN THE DRAWINGS

BEST MODE FOR CARRYING OUT THE INVENTION

Figure 1A:
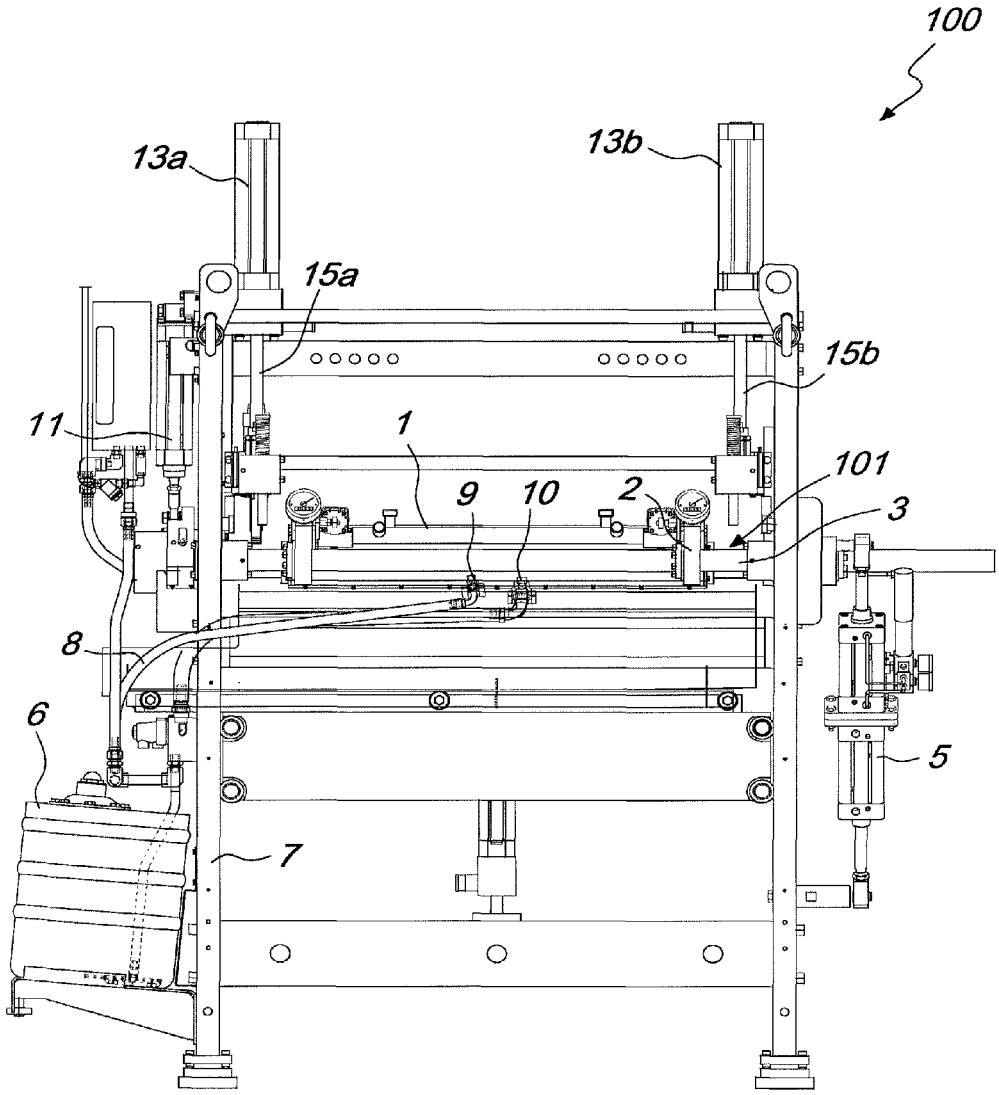
FIG. 1A shows a rotogravure printing unit comprising a chambered doctor blade in non-operational mode according to the invention.
Figure 1B:
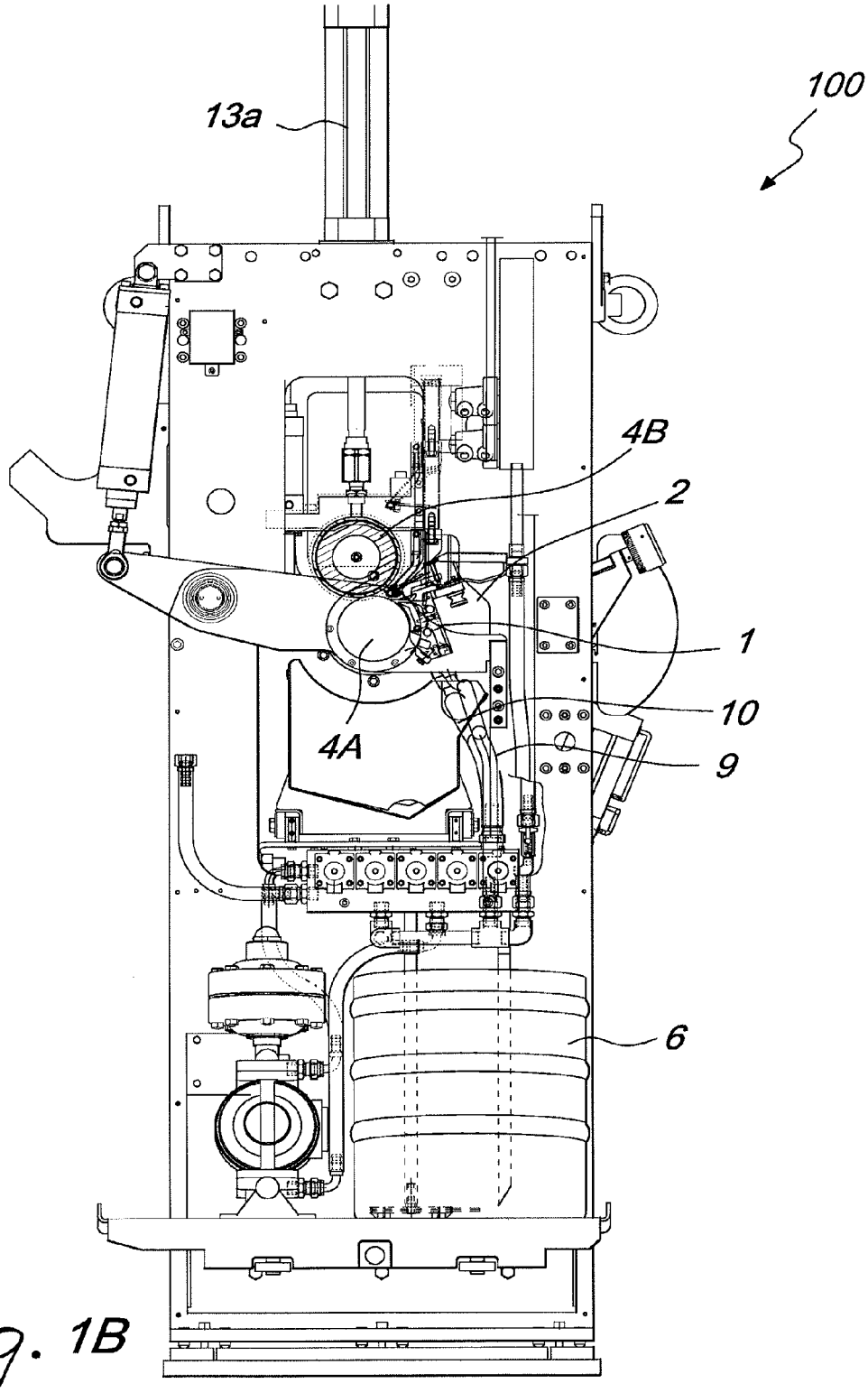
FIG. 1B shows a left-side view of the rotogravure printing unit of FIG. 1A in an operational mode.

With reference to FIGS. 1A and 1B, a rotogravure printing unit 100 incorporating the doctor blade assembly according to the invention comprises at least one gravure printing roller 4A and a pressing roller 4B, both of the conventional kind, which are rotatably mounted on a support frame 7 of the unit 100.

The gravure printing roller 4A features an engraved cylindrical surface, by means of which ink can be entrapped and transferred to a film or web material fed by the pressing roller 4B. The gravure printing roller 4A can be easily disassembled from the unit 100 and replaced by a gravure printing roller having a different diameter and/or different patterns engraved on its surface.

The pressing roller 4B is linearly movable along a path across the rotation axis of the gravure printing roller 4A, so as to be adapted to printing rollers of different diameters and to press the film or web material against the engraved surface of the printing roller 4A.

Preferably, a first motor 13*a* and a second motor 13*b* are located on the top of the support frame 7 and are able to actuate, via a first motor shaft 15*a* and a second motor shaft 15*b*, the pressure roller 4B towards the printing roller 4A.

The rotogravure printing unit 100 further comprises a doctor blade assembly 101 according to the invention. The doctor blade assembly comprises a support structure for a doctor blade such as a chambered doctor blade 1, which support is removably fixed to a holding device 2 substantially at a middle height of the rotogravure printing unit 100.

In particular, the holding device 2 comprises a support rod 3 for connection to a moving means 5 such as a pneumatic, hydraulic or electromechanical actuation device, which is suitable to adjust the position of the holding device and, accordingly, of the doctor blade fixed thereto, with respect to the surface of a printing roller. For instance, the moving means 5 can move the holding device 2 and the rod 3 so as to adapt the radial position of the chambered doctor blade 1 to the diameter of the particular printing roller used, and/or to change the angular position of the chambered doctor blade 1 with respect to the gravure printing roller, and/or to bring the chambered doctor blade 1 to an operational position, i.e. abutting against the gravure printing roller 4A, or to a non-operational position, i.e. away from the gravure printing roller 4A.

Actuation devices for moving doctor blades with respect to the printing rollers, as well as their control software, are well known in the field of rotogravure printing presses for moving non-chambered doctor blades, and will not be discussed in detail here.

Figure 3:
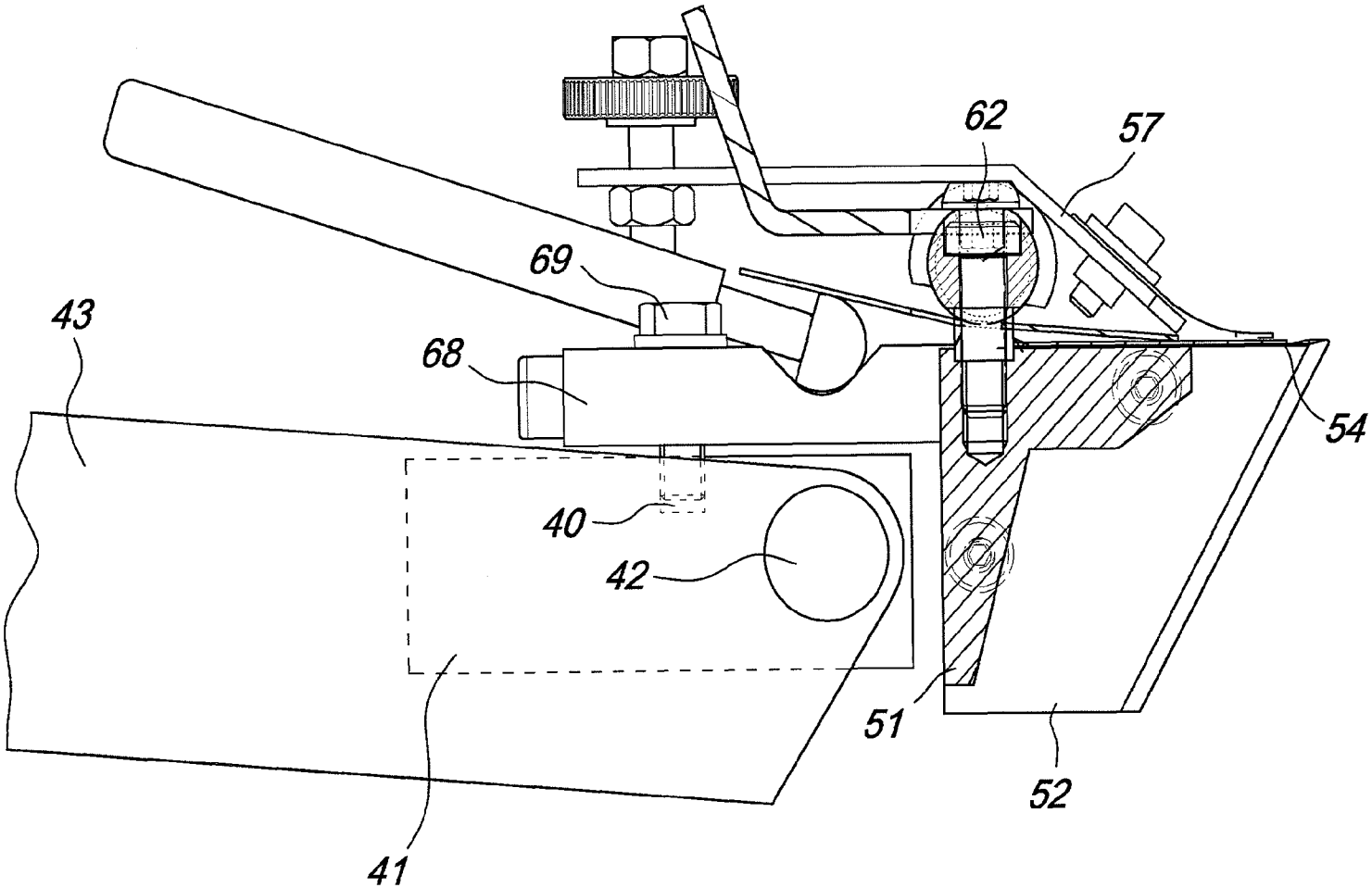
FIG. 3 shows a non-chambered doctor blade assembly in cross-section.
Figure 4:
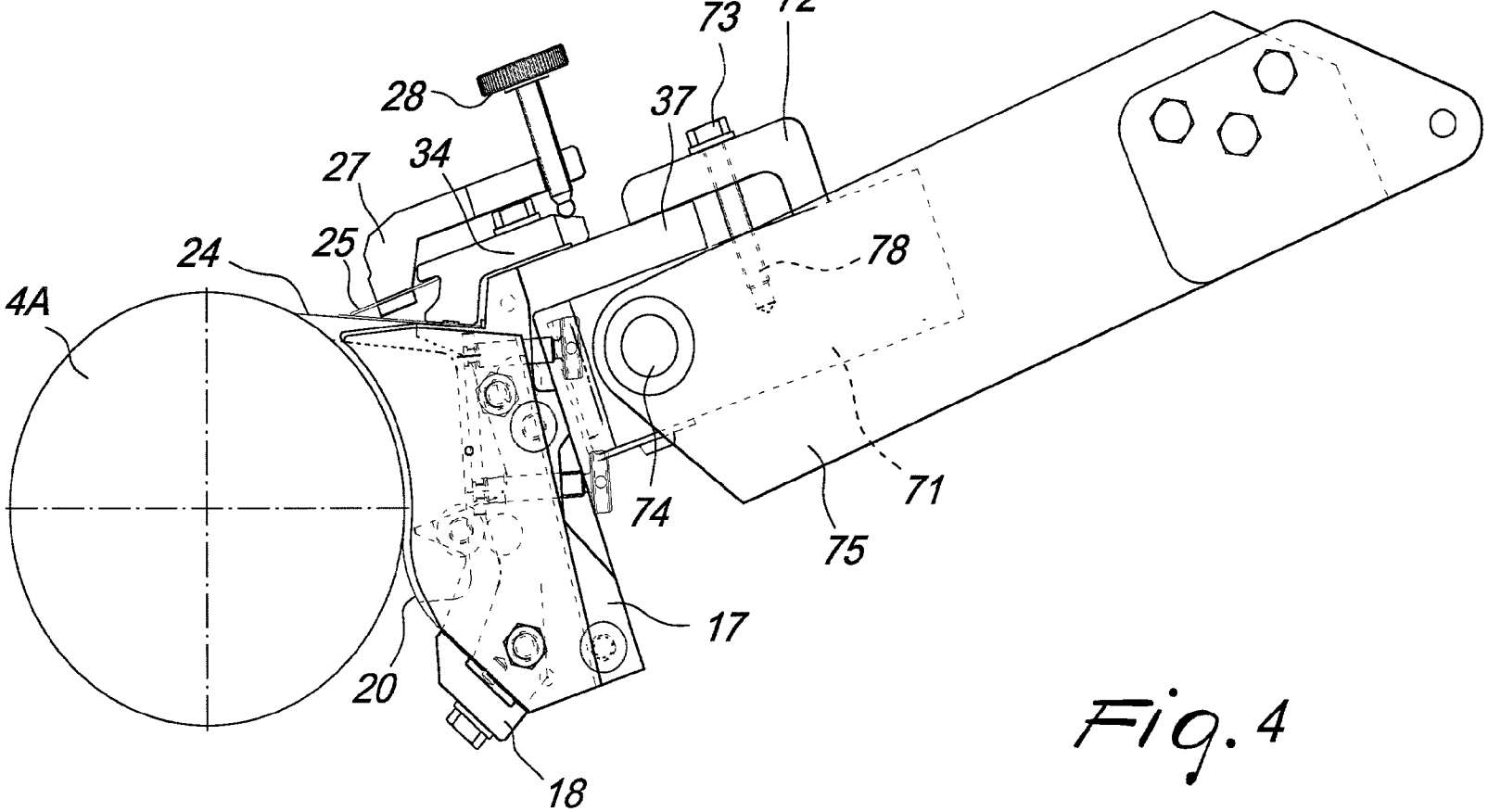
FIG. 4 shows a second chambered doctor blade assembly.
Figure 5:
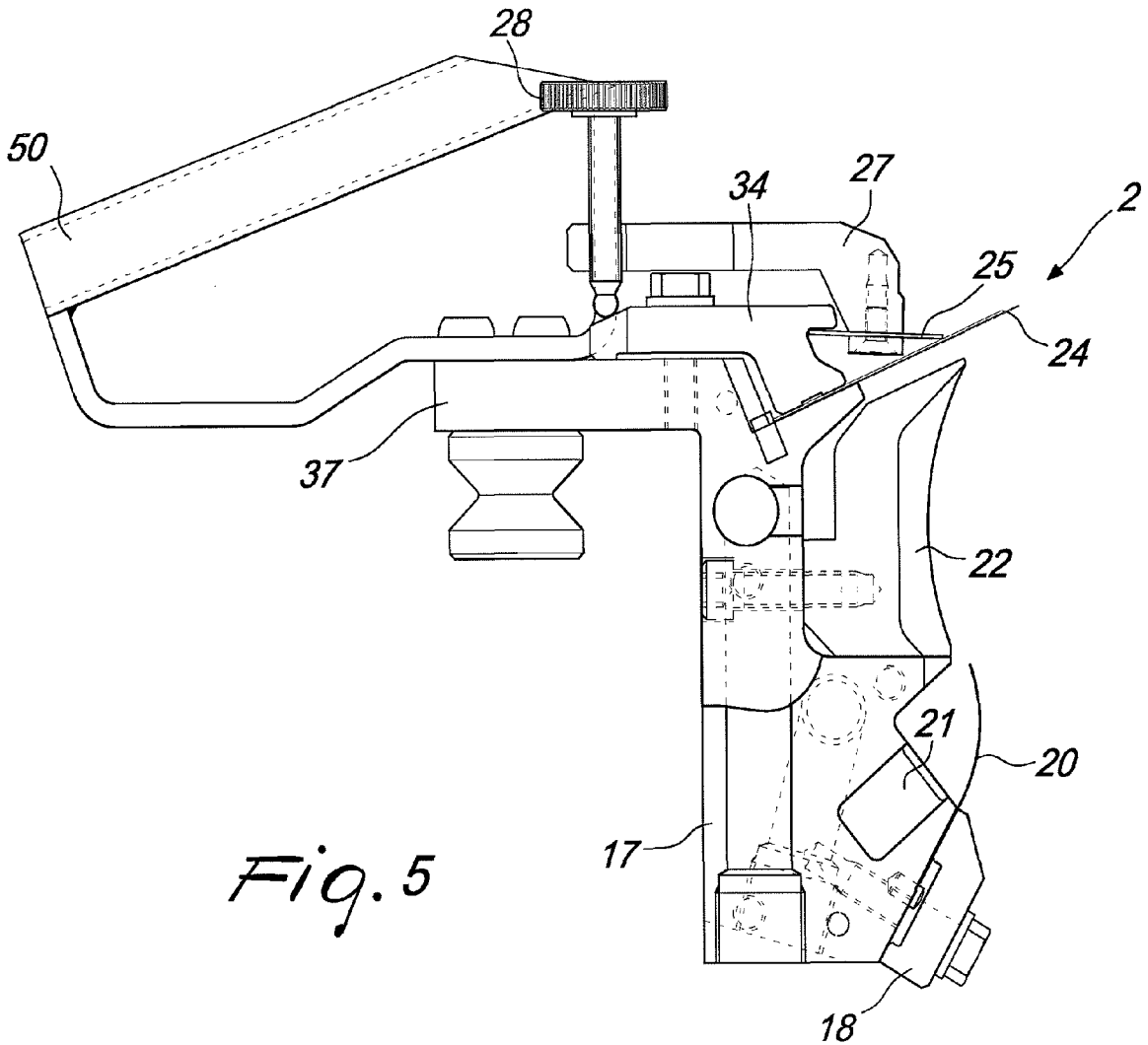
FIG. 5 shows a third chambered doctor blade assembly.

The holding device 2, as it will become apparent from the description of the embodiments of FIG. 3-5, comprises mounting means which are suitable to indifferently fix either a chambered doctor blade 1, like that depicted in FIGS. 1A-1B, or a non-chambered doctor blade to the moving means 5.

A conventional ink pan can be provided beneath the gravure printing roller 4A, so as to make the roller surface be dipped, during its rotation, in the ink contained in the pan. The ink pan should be used in the rotogravure printing unit 100 when the doctor blade fastened to the holding device 2 is a non-chambered doctor blade, such as that shown in FIG. 3.

An ink tank 6 is also provided, preferably outside of the support frame 7, for supplying ink to the rotogravure printing unit when the doctor blade fastened to the holding device 2 is a chambered doctor blade 1, as shown in FIGS. 1A-1B, 2, 4 and 5.

In particular, a hose 8 is connected between the ink tank 6 and a supply inlet 9 of the chambered doctor blade 1. In a preferred embodiment, the supply inlet is located in a bottom region of the chambered doctor blade 1.

A discharge hose 10 is further connected to a corresponding outlet of the chambered doctor blade 1 and in the proximity of the supply inlet 9, for discharging of the ink from the chambered doctor blade 1.

Optionally, a viscometer 11 located above the ink tank 6 may be provided for monitoring viscosity of the ink.

Figure 2:
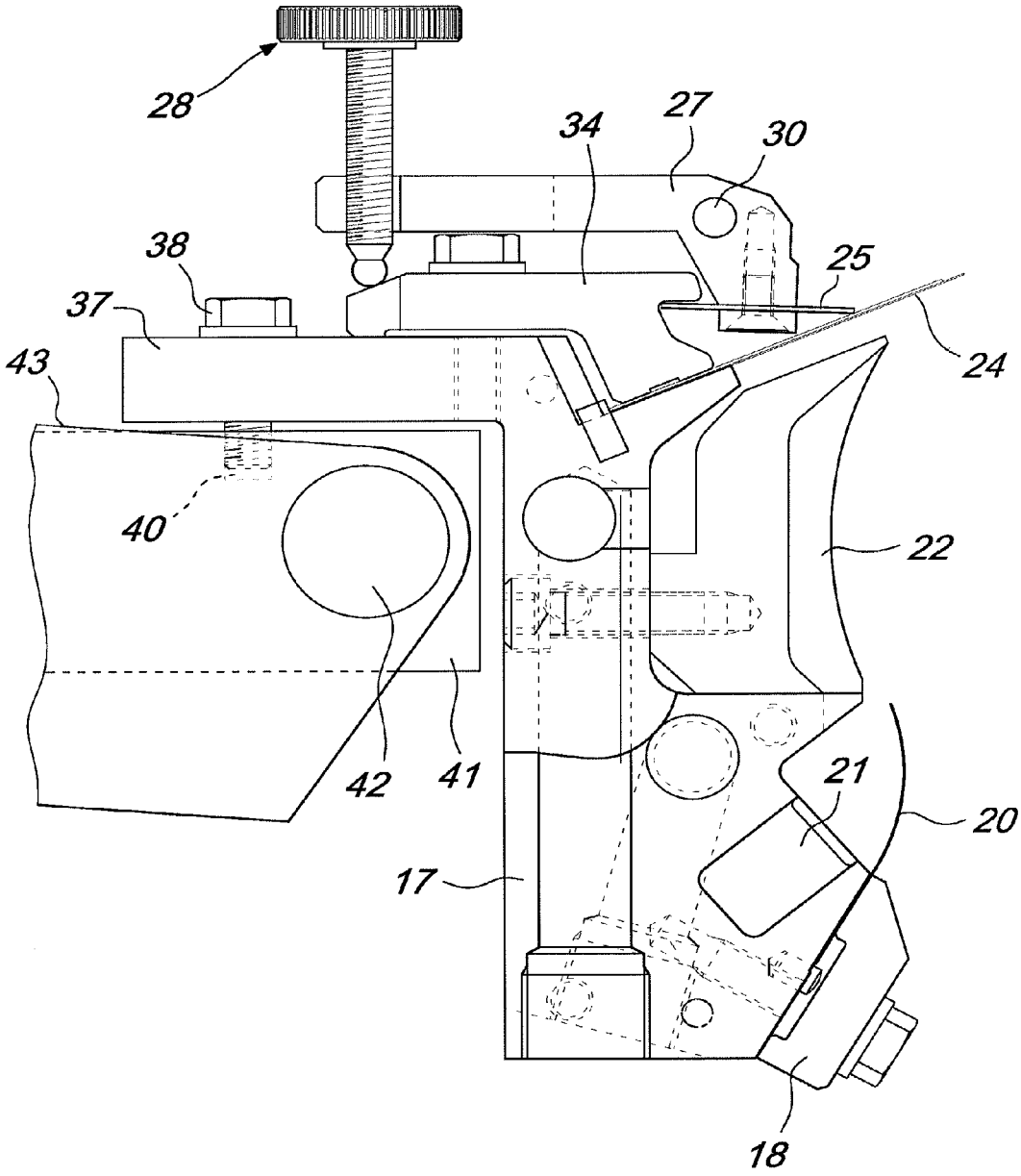
FIG. 2 shows a first chambered doctor blade assembly in cross-section.

FIG. 2 shows a detailed view of a chambered doctor blade 1 in a first embodiment of the present invention. The chambered doctor blade 1 extends along the length of the printing roller 4A and preferably exceeds such length.

The chambered doctor blade 1 comprises a support structure 17 which is substantially L-shaped and a box mounted thereon for defining an ink chamber which is closed by the lateral surface of the printing roller 4A.

In particular, the chamber is defined by a first lower doctor 20, a second upper doctor 24 and lateral contoured walls 22. The first doctor 20 is fastened to the support structure 17 by means of a clamp block 18. The second doctor 24 is located above the first doctor 20 and is fixed to the support structure 17 by means of a second clamp block 34.

A discharge channel 21 for discharging excess ink is preferably located in the support structure 17 below the curved area of the second doctor blade 20. Moreover, a manifold is provided inside the chamber, for allowing ink be sprayed towards the printing roller 4A.

A J-shaped bar 27 is located above the second clamp block 34 and articulated to a pivot 30. An adjustment element 28 is provided on the flat arm of the J-shaped bar 27, for changing the slope of the second doctor 24. A first plate 25 is fixed to the end surface of the curved side of the J-shaped bar 27 and contacts the second doctor 24. As a consequence, by turning the adjustment element 28, the J-shaped bar 27 can rotate clockwise or counter clockwise around pivot 30, changing the angle of the second doctor 24 with respect to the surface of the printing roller 4A.

The holding device 2 comprises a substantially rectangular support block 41 which comprises mounting means adapted for the support structure of both the chambered doctor blade shown in FIG. 2 and the non-chambered doctor blade shown in FIG. 3.

In the particular embodiment depicted in FIG. 2, the mounting means comprise a threaded hole 40 on the side facing the bottom surface of an arm 37 of the L-shaped support structure 17, which hole is suitable for a corresponding screw 38 of the L-shaped support structure 17 of the chambered doctor blade and for a corresponding screw 69 of the L-shaped support structure 51 of the non-chambered doctor blade (see FIG. 3).

Articulated to a pivot 42 is a support lever 43 of the actuation device 5, which is suitable to adjust the position of the chambered doctor blade with respect to the printing roller 4A. The actuation device, preferably, is computer controlled for achieving a high precision positioning.

The chambered doctor blade of FIG. 2 may comprise handles fixed to the support structure 17, such as the handle 50 depicted in FIG. 5, which allow easy assembling or disassembling of the chambered doctor blade and its support structure with respect to the holding device 41.

FIG. 3 shows a non-chambered doctor blade assembly mounted on the same holding device 41 and its corresponding support lever 43 of FIG. 2. The non-chambered doctor blade has a support structure 51 which defines, together with an elongated arm 68, a substantially L-shaped support structure.

Attached to the support structure 51 are trapezoid side plates 52 and an upper doctor 54, which is held in place by a plate 57 and a fixing element 62.

The non-chambered doctor blade of FIG. 3 may also comprise handles fixed to the support structure 51, suitable to easily assemble or disassemble the non-chambered doctor blade and its support structure with respect to the holding device 41.

FIG. 4 shows a further embodiment of the invention, in which the mounting means of the holding device of the chambered doctor blade of FIG. 2 have been slightly changed with respect to the corresponding mounting means of FIGS. 2 and 3.

In particular, the holding device is a holding block 71 comprising, on its upper surface, a mounting means in the form of a protruding clamp 72 and its corresponding clamping screw 73 and, below the free end of the clamp 72, a threaded hole 78 for the clamping screw 73.

The holding block 71, as the holding device of FIGS. 2-3, is pivoted at 74 to a support lever 75 of moving means for adjusting the position of the chambered doctor blade with respect to the printing roller 4A. The moving means, preferably, are computer controlled for achieving a high precision positioning.

The clamp 72 is located on the holding block 71 so that the free arm of the clamp is directed substantially towards the same direction of the front edge of the holding block 71, in order to clamp and fix the L-shaped support structure of the doctor blade to the holding block 71.

As it is apparent to the person skilled in the art, further mounting means different from those described above can be provided which are independent of the particular kind of doctor blade unit to be used in the rotogravure printing press, i.e. regardless of whether the doctor blade is chambered or non-chambered. For instance, snap-fit or geometrical couplings can be provided in the alternative, without altering the interchangeability features of the instant invention.

The holding device may be provided with one or more of the mounting means listed above, as well as with their equivalents, so as to be adapted to support different doctor blade units.

FIG. 5 shows a chambered doctor blade according to a further embodiment of the instant invention. The chambered doctor blade differs from the chambered doctor blade of FIG. 2 in that it further comprises a handle 50 which is fixed to the upper surface of the L-shaped support structure 17. Preferably, two handles 50 are provided on the L-shaped support structure 17, so that a user can easily grip the chambered doctor blade unit and remove it from the holding device, as well as fit it onto the holding device.

The operation of the invention is as follows. When the rotogravure printing unit 100 is used with inks typically suitable for conventional rotogravure printing, a non-chambered doctor blade, such as that shown in FIG. 3, is fixed to the holding device 2 and the moving means 5 are actuated so as to adjust and maintain the position of the non-chambered doctor blade with respect to the lateral surface of the gravure printing roller 4A. The ink pan beneath the gravure printing roller 4A is filled with ink, so that the gravure printing roller 4A can be wet with the ink during its rotation and the excess ink can be removed from the engraved surface of the roller 4A by means of the doctor of the non-chambered doctor blade unit before printing the film or web material supplied by the pressing roller.

When a different printing operation is needed, for instance an operation in which an ink having a fast drying must be used, the moving means 5 are actuated so as to move the non-chambered doctor blade unit away from the printing roller, in the non-operational position, and the user can easily disassemble the non-chambered doctor blade and its support structure from the holding device, e.g. by removing the screw 69 and lifting the non-chambered doctor blade unit by means of the handles fixed to its support structure. The ink pan is emptied from the ink used in the previous printing cycle or can be moved away from the printing roller 4A.

Then, the chambered doctor blade, such as that shown in FIG. 5, is brought and fitted onto the holding device 2 by means of the handles 50 and is finally fixed to the holding device, e.g. by means of the screw 38 in the same threaded hole 40 of the holding block 41.

Finally, after having connected the chamber of the chambered doctor blade unit to the ink tank 6 by means of hoses 8 and 10, the moving means are actuated so as to bring the holding device and the chambered doctor blade unit in the operational position, i.e. at the periphery of the gravure printing roller 4A. Accordingly, the ink is supplied to the printing roller 4A at an angular position which is closer to the pressing roller than the position of the ink pan, allowing to use inks that could not be otherwise used in a rotogravure printing unit.

It has been shown that the invention achieves the intended aim and objects. In particular, a doctor blade assembly has been provided which allows different inks or substances to be used within the same printing unit, because of the provision of mounting means which allow different kinds of doctor blade units to be installed thereon.

The interchangeability which characterizes the doctor blade assembly according to the invention allows a printing unit to be easily switched from one printing mode to another printing mode. An important consequence is that the cleaning operations of printing presses such as rotogravure printing presses are drastically reduced, because such printing presses can also operate with chambered doctor blade units, without causing ink splashes and other well known drawbacks due to the interaction between the printing roller and the ink pan or vessel beneath the roller.

Moreover, the provision of a doctor blade assembly according to the invention does not need any substantial alteration of the mechanical structure and of the operating software of existing printing unit, which can be easily updated with such assembly.

Although the assembly according to the invention has been conceived in particular for gravure or rotogravure printing presses, it can nonetheless also be used for other kinds of rotary printing presses which use doctor blades.

The assembly thus conceived is susceptible of numerous modifications and variations, all of which are within the scope of the appended claims. All the details may further be replaced with other technically equivalent elements.

The invention claimed is:

1. A method for allowing different inks to be used within the same printing unit incorporating a doctor blade assembly, comprising a support structure for supporting a doctor blade, a holding device for holding the support structure, a moving device of the holding device operable to move the holding device, the support structure and the doctor blade with respect to a gravure printing roller between a position for enabling doctoring of the gravure printing roller and a position spaced further away from the gravure printing roller, the method comprising the steps of:

actuating the moving means so as to move a non-chambered doctor blade unit away from a printing roller, disassembling the non-chambered doctor blade unit and its support structure from the holding device, lifting the non-chambered doctor blade unit, bringing and fitting a chambered doctor blade unit onto the holding device, fixing the chambered doctor blade unit to the holding device, and actuating the moving means so as to bring the holding device and the chambered doctor blade unit at the periphery of the printing roller.

* * * * *